US007190125B2

(12) United States Patent
McDonough et al.

(10) Patent No.: US 7,190,125 B2
(45) Date of Patent: Mar. 13, 2007

(54) PROGRAMMABLE WALLBOX DIMMER

(75) Inventors: Bridget McDonough, Bethlehem, PA (US); Walter S. Zaharchuk, Macungie, PA (US); Edward J. Blair, Lansdale, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 187 days.

(21) Appl. No.: 10/892,510

(22) Filed: Jul. 15, 2004

(65) Prior Publication Data

US 2006/0012315 A1 Jan. 19, 2006

(51) Int. Cl.
*G05F 1/00* (2006.01)

(52) U.S. Cl. ..... 315/291; 315/294; 307/115

(58) Field of Classification Search ..... 315/291, 315/307, 316, 224, DIG. 4, 209 R, 219, 294, 315/297, 362; 307/115
See application file for complete search history.

(56) References Cited

U.S. PATENT DOCUMENTS

| | | | | |
|---|---|---|---|---|
| 5,248,919 A | | 9/1993 | Hanna et al. | 315/291 |
| 5,798,581 A | * | 8/1998 | Keagy et al. | 307/115 |
| 5,905,442 A | | 5/1999 | Mosebrook et al. | 340/825.06 |
| 5,909,087 A | | 6/1999 | Bryde et al. | 315/149 |
| 6,046,550 A | * | 4/2000 | Ference et al. | 315/291 |
| 6,169,377 B1 | * | 1/2001 | Bryde et al. | 315/294 |
| 6,225,760 B1 | * | 5/2001 | Moan | 315/360 |
| 6,285,912 B1 | | 9/2001 | Ellison et al. | 700/11 |
| 6,545,434 B2 | * | 4/2003 | Sembhi et al. | 315/312 |
| 7,081,715 B1 | * | 7/2006 | Goldstein | 315/159 |
| 2002/0005435 A1 | | 1/2002 | Cottrell | 236/46 |
| 2002/0014972 A1 | | 2/2002 | Danielson et al. | 340/815.4 |

OTHER PUBLICATIONS

U.S. Appl. No. 10/753,035, filed Jan. 7, 2004, Johnson et al.

* cited by examiner

*Primary Examiner*—Tuyet Vo
*Assistant Examiner*—Jimmy Vu
(74) *Attorney, Agent, or Firm*—Woodcock Washburn LLP

(57) ABSTRACT

A programmable wallbox dimmer is disclosed. Upon entering a programming mode, the dimmer presents a main menu from which the user may select one or more features to program. The user may scroll through a list of programmable features by actuating the dimmer's raise/lower intensity actuator. The user may select a highlighted feature by actuating the dimmer's control switch. The dimmer may enter a value selection mode that is associated with the selected feature. In the value selection mode, the user may scroll through a list of features that define the selected feature by actuating the dimmer's raise/lower intensity actuator. The user may select a value for the selected feature. The selected value may be stored in the dimmer's memory.

24 Claims, 7 Drawing Sheets

PROGRAMMABLE WALLBOX DIMMER

FIELD OF THE INVENTION

Generally, the invention relates to lighting control devices. More particularly, the invention relates to programmable wallbox dimmers.

BACKGROUND OF THE INVENTION

FIG. 1 depicts a typical dimmer circuit 100 comprising a source of electrical energy or power supply 112, a dimmer 114, and a lighting load 116. The lighting load 116 may be a lamp set comprising one or more lamps adapted to be connected between the hot and neutral terminals of a standard source of electrical energy. The lamp set may include one or more incandescent lamps and/or other lighting loads such as electronic low voltage (ELV) or magnetic low voltage (MLV) loads, for example.

The power supply 112 supplies an electrical waveform to the dimmer 114. The dimmer regulates the delivery of electrical energy from the power supply 112 to the lighting load 116. The dimmer 114 may include a controllably conductive device 118 and a control circuit 120. The controllably conductive device 118 may include an input 122 adapted to be coupled to the power supply 112, an output 124 adapted to be coupled to the lighting load 116, and a control input 126. The control circuit 120 may have an input 128 coupled to the input 122 of the controllably conductive device 118 and an output 130 coupled to the control input 126 of the controllably conductive device 118.

A typical, AC, phase-control dimmer regulates the amount of energy supplied to the lighting load 116 by conducting for some portion of each half-cycle of the AC waveform, and not conducting for the remainder of the half-cycle. Because the dimmer 114 is in series with the lighting load 116, the longer the dimmer 114 conducts, the more energy will be delivered to the lighting load 116. Where the lighting load 116 is a lamp set, the more energy delivered to the lighting load 116, the greater the light intensity level of the lamp set. In a typical dimming scenario, a user may adjust a control to set the light intensity level of the lamp set to a desired light intensity level. The portion of each half-cycle for which the dimmer conducts is based on the selected light intensity level.

The controllably conductive device 118 may include a solid state switching device, which may include one or more triacs, which may be thyristors or similar control devices. Conventional light dimming circuits typically use triacs to control the conduction of line current through a load, allowing a predetermined conduction time, and control the average electrical power to the light. One technique for controlling the average electrical power is forward phase control. In forward phase control, a switching device, which may include a triac, for example, is turned on at some point within each AC line voltage half cycle and remains on until the next current zero crossing. Forward phase control is often used to control energy to a resistive or inductive load, which may include, for example, a magnetic lighting transformer.

Because a triac device can only be selectively turned on, a power-switching device, such as a field effect transistor (FET), a MOSFET (metal oxide semiconductor FET), or an insulated gate bipolar transistor (IGBT), for example, may be used for each half cycle of AC line input when turn-off phase is to be selectable. In reverse phase control, the switch is turned on at a voltage zero-crossing of the AC line voltage and turned off at some point within each half cycle of the AC line current. A zero-crossing is defined as the time at which the voltage equals zero at the beginning of each half-cycle. Reverse phase control is often used to control energy to a capacitive load, which may include for example, an electronic transformer connected low voltage lamp.

The switching device may have a control or "gate" input 126 that is connected to a gate drive circuit, such as an FET drive circuit, for example. Control inputs on the gate input render the switching device conductive or non-conductive, which in turn controls the energy supplied to the load. FET drive circuitry typically provides control inputs to the switching device in response to command signals from a microcontroller. FET protection circuitry may also be provided. Such circuitry is well known and need not be described herein.

The microcontroller may be any processing device such as a programmable logic device (PLD), a microprocessor, or an application specific integrated circuit (ASIC), for example. Power to the microcontroller may be supplied by a power supply. A memory, such as an EEPROM, for example, may also be provided.

Inputs to the microcontroller may be received from a zero-crossing detector. The zero-crossing detector determines the zero-crossing points of the input waveform from the power supply 112. The microcontroller sets up gate control signals to operate the switching device to provide voltage from the power supply 112 to the load 116 at predetermined times relative to the zero-crossing points of the waveform. The zero-crossing detector may be a conventional zero-crossing detector, and need not be described here in further detail. In addition, the timing of transition firing pulses relative to the zero crossings of the waveform is also known, and need not be described further.

FIGS. 2A and 2B depict an example lighting control device, or "dimmer," 114 that may be programmable in accordance with the invention. As shown, the lighting control device 114 may include a faceplate 12, a bezel 13, an intensity selection actuator 14 for selecting a desired level of light intensity of a lighting load 116 controlled by the lighting control device 114, a control switch actuator 16, and an air gap actuator 17. Faceplate 12 need not be limited to any specific form, and is preferably of a type adapted to be mounted to a conventional wall box commonly used in the installation of lighting control devices. Likewise, bezel 13 and actuators 14, 16, and 17 are not limited to any specific form, and may be of any suitable design that permits manual actuation by a user.

Actuation of the upper portion 14*a* of actuator 14 increases or raises the light intensity of lighting load 116, while actuation of lower portion 14*b* of actuator 14 decreases or lowers the light intensity. Actuator 14 may control a rocker switch, two separate push switches, or the like. Actuator 16 may control a push switch, though actuator 16 may be a touch-sensitive membrane or any other suitable type of actuator. Actuators 14 and 16 may be linked to the corresponding switches in any convenient manner. The switches controlled by actuators 14 and 16 may be directly wired into the control circuitry to be described below, or may be linked by an extended wired link, infrared link, radio frequency link, power line carrier link, or otherwise to the control circuitry.

Air gap actuator 17 is provided in order to open an air gap switch in the lighting control device 114. The air gap switch disconnects the power supply 112 from the controllably conductive device 118, the control circuit 130, and the lighting load 116. The air gap switch is opened by pulling the air gap actuator 17 away from the faceplate 12 of the lighting control device 114.

Lighting control device 114 may also include an intensity level indicator in the form of a plurality of light sources 18. Light sources 18 may be light-emitting diodes (LEDs), for example, or the like. Light sources 18 may occasionally be referred to herein as LEDs, but it should be understood that such a reference is for ease of describing the invention and in not intended to limit the invention to any particular type of light source. Light sources 18 may be arranged in an array (such as a linear array as shown) representative of a range of light intensity levels of the lighting load being controlled. The intensity levels of the lighting load may range from a minimum intensity level, which is preferably the lowest visible intensity, but which may be zero, or "full off," to a maximum intensity level, which is typically "full on." Light intensity level is typically expressed as a percent of full intensity. Thus, when the lighting load is on, light intensity level may range from 1% to 100%.

By illuminating a selected one of light sources 18 depending upon light intensity level, the position of the illuminated light source within the array may provide a visual indication of the light intensity relative to the range when the lighting load being controlled is on. For example, seven LEDs are illustrated in FIGS. 2A and 2B. Illuminating the uppermost LED in the array may indicate that the light intensity level is at or near maximum. Illuminating the center LED may indicate that the light intensity level is at about the midpoint of the range. Any convenient number of light sources 18 may be used, and it should be understood that a larger number of light sources in the array will yield a commensurately finer gradation between intensity levels within the range.

When the lighting load 116 being controlled is off, the LED representative of the intensity level at which the lighting load will turn on to may be illuminated at a relatively high illumination level, while the remaining light sources may be illuminated at a relatively low level of illumination. This enables the light source array to be more readily perceived by the eye in a darkened environment, which assists a user in locating the lighting control device 114 in a dark room, for example, in order to actuate the lighting control device 114 to control the lights in the room. Still, sufficient contrast may be provided between the level-indicating LED and the remaining LEDs to enable a user to perceive the relative intensity level at a glance.

Lighting control device 114 may include a standard back box 20 having a plurality of high voltage screw terminal connections 22H, 22N, 22D that may be connections for hot, neutral, and dimmed hot, respectively.

Such lighting control devices typically provide certain features such as, for example, protected preset, fading, and the like. Some such lighting control devices may enable a user to set a value associated with a feature the lighting control device provides. For example, lighting control devices are known that enable a user to set a light intensity value associated with the "protected preset" feature (see, for example, U.S. Pat. No. 6,169,377, which describes a lighting control unit having the protected or "locked" preset feature).

Protected preset is a feature that allows the user to lock the present light intensity level as a protected preset light intensity level to which the dimmer should set the lighting load 116 when turned on by actuation of actuator 16. After a protected preset is assigned by a user, the protected preset feature is considered enabled. The user can also disable (or unlock) the protected preset.

When the dimmer is turned on via actuator 16 while protected preset is disabled, the dimmer will set the lighting load 116 to the intensity level at which the dimmer was set when the lighting load was last turned off. Accordingly, when the lighting load 116 is turned off via actuator 16, the light intensity level at which the lighting load was set is stored in memory. When the lighting load 116 is turned on via actuator 16, the microcontroller reads from memory the value of the last light intensity level, and causes the lighting load to be set to that level.

When the dimmer is turned on via actuator 16 while protected preset is enabled, the dimmer will set the lighting load 116 to the protected preset intensity level. When the lighting load 116 is turned off via actuator 16, the light intensity level at which the lighting load was set is not stored in memory. When the lighting load 116 is turned on, the microcontroller reads the protected preset intensity level value from memory and causes the lighting load to be set to the protected preset level.

To enable the protected preset feature by locking the present light intensity level as the protected preset intensity level, a user may follow the following procedure. First, actuator 14 may be used to set the lighting load to a desired intensity level. With the lighting load 116 at the desired intensity level, the user may then "quad tap" actuator 16, i.e., tap actuator 16 four times in rapid succession (e.g., less than ½ sec between taps). The LED corresponding to the level at which the lighting load 116 was initially set will then blink twice, and the microprocessor will cause the selected light intensity level to be stored in memory as the protected preset intensity level. Note that the quad tap is actually a "save" operation. That is, the dimmer enables the user to save in memory a value associated with a current light intensity level as a protected preset value. Thereafter, whenever the lights are turned on, the dimmer will cause the lighting load 116 to go to the stored preset intensity level. Protected preset maybe deactivated by another quad tap.

It has been found that, in such a dimmer, protected preset may be accidentally implemented. That is, a user may quad tap actuator 16 and activate or deactivate protected preset inadvertently. Also, the quad tap enables the user to set only one parameter associated with only one feature the dimmer provides. It would be desirable, therefore, if apparatus and methods were available that enabled a user of such a wallbox dimmer to program one or more features of the dimmer using only the limited user interface such a dimmer provides.

SUMMARY OF THE INVENTION

The invention provides a programmable lighting control device that controls a light intensity level of at least one lamp. The lighting control device may include a user-actuatable intensity selector, a user-actuatable control switch, a user-actuatable air gap controller, and a microcontroller operatively coupled to the intensity selector, the control switch, and the air gap controller. In a normal operational mode, the intensity selector enables a user to select a desired intensity level between a minimum intensity level and a maximum intensity level, the control switch enables the user to turn the lamp on and off, and the air gap controller enables the user to disrupt power to the lighting control device.

The device may also include an intensity level indicator in the form of a plurality of light sources, such as LEDs. In normal operational mode, the LED associated with the current light intensity level may be lit.

According to the invention, the microcontroller may be adapted to enter a programming mode after determining that the air gap has been opened, that the control switch has been actuated while the air gap is open, that the air gap has been closed while the control switch is actuated, and that the control switch has remained actuated for at least a prescribed period of time after the air gap was closed.

Upon entering the programming mode, the dimmer presents a first, or "main," menu from which the user may select one or more features to program. In the main menu, each of one or more of the LEDs is associated with a respective programmable feature. The microcontroller may cause the LED associated with a default feature to begin to blink at a first, relatively slow rate. While in the main menu, the user may actuate the raise/lower switches to scroll through the list of programmable features. The user may actuate the toggle actuator to select the currently highlighted feature. Depending on the feature selected, the microcontroller may provide either a parameter selection menu or a value selection menu that is associated with the selected feature.

In the parameter selection menu, each of one or more LEDs may be associated with a respective parameter that defines the selected feature. Using the raise/lower actuator, the user may scroll through the parameter selection menu and select a highlighted parameter by actuating the control switch actuator. In the value selection menu, each of one or more LEDs may be associated with a respective prescribed value that may be selected for a parameter that defines the selected feature, which parameter may have been selected via a parameter selection menu. Using the raise/lower actuator, the user may scroll through the value selection menu and select a value for the selected parameter. The selected value is stored in memory.

The user may exit programming mode and return the dimmer to normal operating mode in a number of ways. For example, the user could do nothing (i.e., not actuate any switch) for a prescribed timeout period. Alternatively, the user could cycle the air gap to exit programming mode, or press and hold the toggle button for a prescribed period of time (e.g., four seconds).

DETAILED DESCRIPTION OF ILLUSTRATIVE EMBODIMENTS

Figure 1:
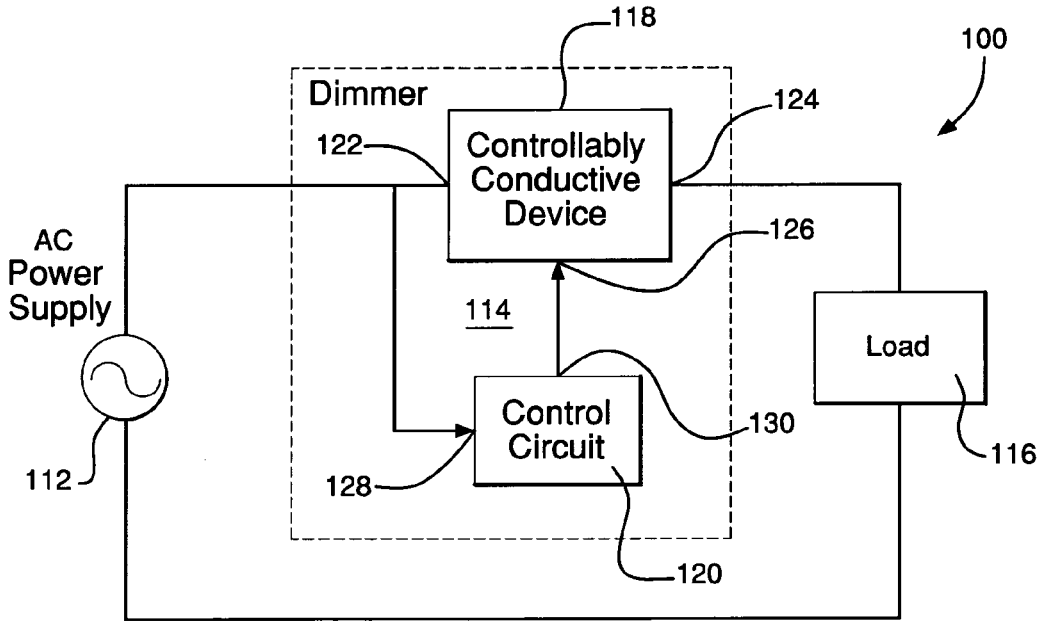
FIG. 1 depicts a typical dimmer circuit.
Figure 2A:
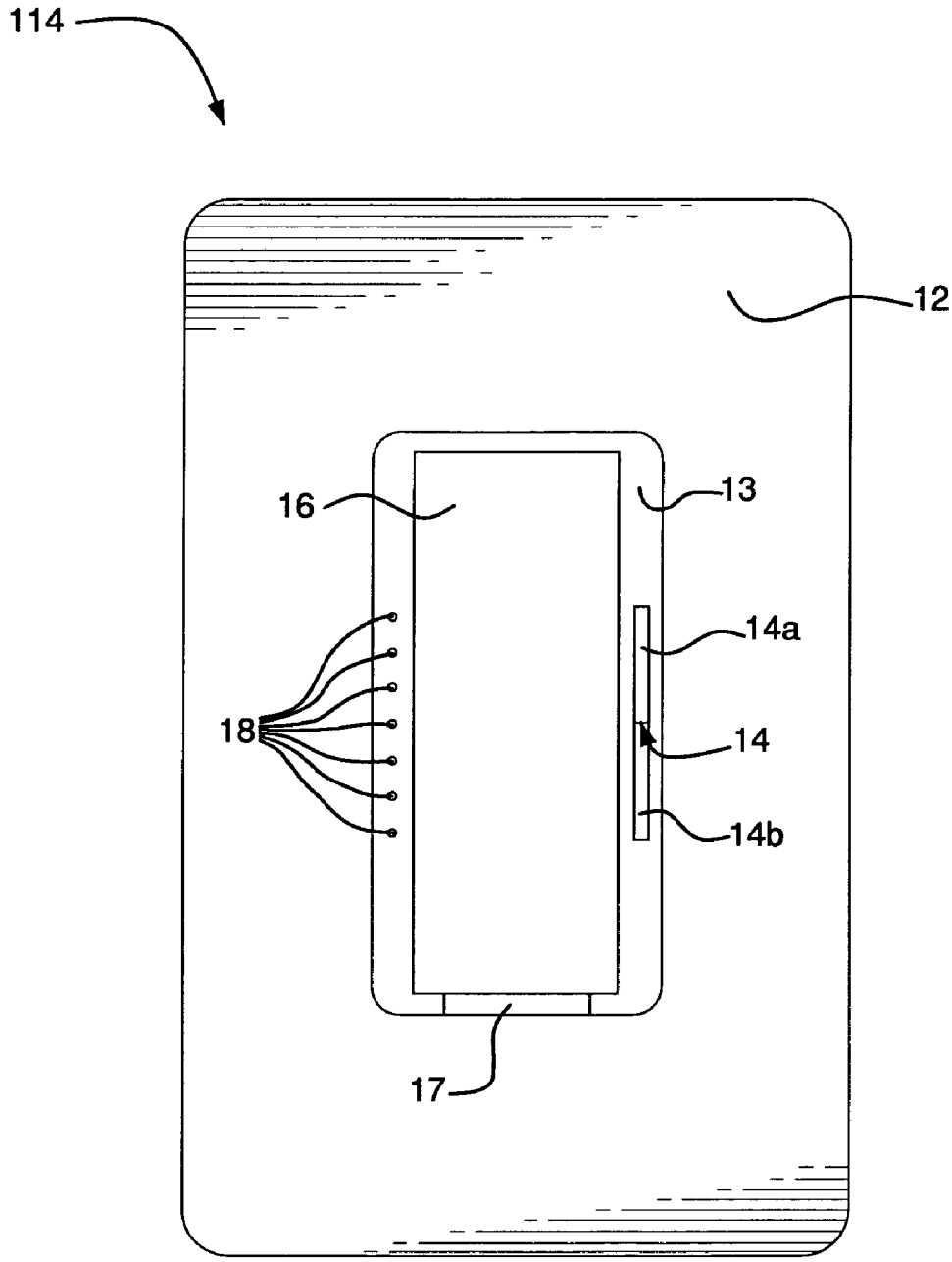
FIGS. 2A and 2B depict an example wall control that may be programmable in accordance with the invention.
Figure 2B:
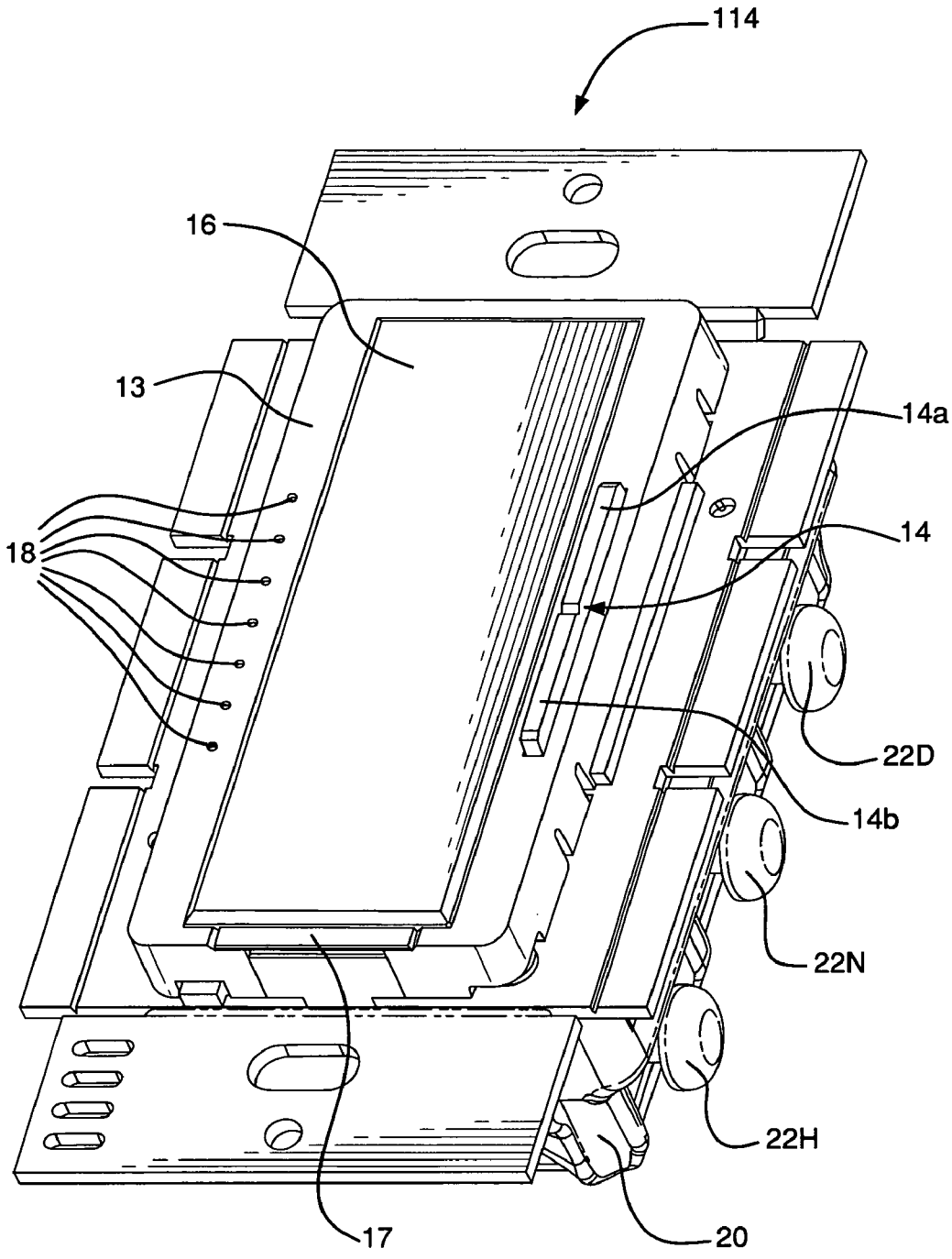
Figure 3:
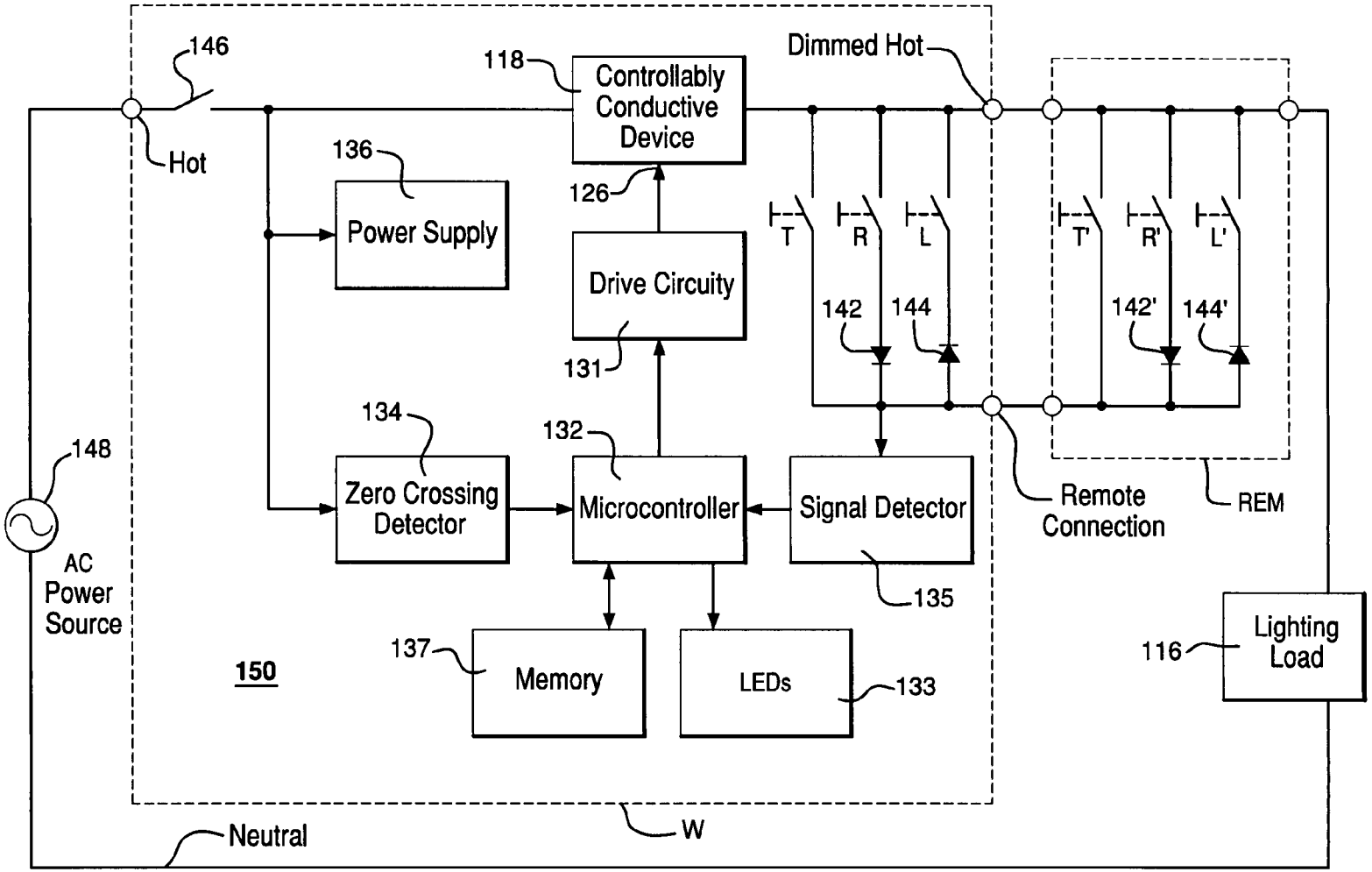
FIG. 3 is a simplified block diagram of example circuitry for a lighting control device according to the invention.

FIG. 3 is a simplified block diagram of example circuitry for a lighting control device 150 according to the invention. The circuitry schematically illustrated in FIG. 3 as W and REM, or any portion thereof, may be contained in a standard back box, such as back box 20.

A lighting load 116, which may include one or more lamps, may be connected between the hot and neutral terminals of a standard power source 148 (of 120 V, 60 Hz AC power, for example). Lighting load 116 may include one or more incandescent lamps, for example, though it should be understood that the lighting load 116 may include other loads, such as electronic low voltage (ELV) or magnetic low voltage (MLV) loads, for example, in addition to or instead of incandescent lighting.

The lighting load 116 may be connected through a controllably conductive device 118. Controllably conductive device 118 has a control, or gate, input 126, which is connected to a gate drive circuit 131. It should be understood that control inputs on the gate input 126 will render the controllably conductive device 118 conductive or non-conductive, which in turn controls the power supplied to the lighting load 116. Drive circuitry 131 provides control inputs to the controllably conductive device 118 in response to command signals from a microcontroller 132.

Phase-controlled dimmers are well known and perform dimming functions by selectively connecting the AC power source 148 to the lighting load 116 during each half-cycle of the AC waveform received from the power source. The AC power may be switched using controllably conductive devices such as triacs, anti-parallel SCRs, field effect transistors (FETs), or insulated gate bipolar transistors (IGBTs). The amount of dimming is determined by the ratio of "ON" time to "OFF" time of the controllably conductive device 118.

In conventional forward phase-controlled dimming, the controllably conductive device (triac or SCR) is OFF at the beginning of each half-cycle (i.e., at the zero crossing) and turned ON later in the half-cycle. Forward phase-controlled dimming may be desirable where the load is inductive or resistive, which may include, for example, a magnetic lighting transformer. In reverse phase-controlled dimming, the controllably conductive device (FET or IGBT) is switched ON to supply power to the load at or near the zero crossing and is switched OFF later during the half-cycle. Reverse phase-controlled dimming may be desirable where the load is capacitive, which may include, for example, an electronic transformer connected low voltage lamp. For each method of phase-controlled dimming, the ratio of ON time to OFF time is determined based on a user-selected desired intensity level.

Microcontroller 132 may be any programmable logic device (PLD), such as a microprocessor or an application specific integrated circuit (ASIC), for example. Microcontroller 132 generates command signals to LEDs 133. Inputs to microcontroller 132 are received from AC line zero-crossing detector 134 and signal detector 135. Power to microcontroller 132 is supplied by power supply 136. A memory 137, such as an EEPROM (Electrically Erasable Programmable Read-Only Memory), for example, may also be provided. Air gap switch 146 is provided and is normally in the closed state. When air gap switch is opened via air gap switch actuator 17, all components of the lighting control device 150 are cut off from the AC power source 148.

Zero-crossing detector 134 determines the zero-crossing points of the input 60 Hz AC waveform from the AC power source 148. The zero-crossing information is provided as an input to microcontroller 132. Microcontroller 132 sets up gate control signals to operate controllably conductive device 118 to provide voltage from the AC power source to lighting load 116 at predetermined times relative to the zero-crossing points of the AC waveform. Zero-crossing detector 134 may be a conventional zero-crossing detector and need not be described here in further detail. In addition, the timing of transition firing pulses relative to the zero crossings of the AC waveform is also known, and need not be described further.

Signal detector 135 receives as inputs switch closure signals from switches designated T, R, and L. Switch T corresponds to the toggle switch controlled by switch actuator 16, and switches R and L correspond to the raise and lower switches controlled by the upper portion 14*a* and lower portion 14*b*, respectively, of intensity selection actuator 14.

Closure of switch T will connect the input of signal detector 135 to the Dimmed Hot terminal of the lighting control device 150 when controllably conductive device 118 is non-conducting, and will allow both positive and negative half-cycles of the AC waveform to reach signal detector 135. Closure of switches R and L will also connect the input of signal detector 135 to the Dimmed Hot terminal when the controllably conductive device 118 is non-conducting. However, when switch R is closed, only the positive half-cycles of the AC waveform are passed to signal detector 135 because of series diode 142. Series diode 142 is connected with its anode to switch R and its cathode to signal detector 135, so that only positive polarity signals are passed by diode 142. In similar manner, when switch L is closed, only the negative half-cycles of the AC waveform are passed to signal detector 135 because of series diode 144, which is connected so as to allow only negative polarity signals to pass to signal detector 135.

Signal detector 135 detects when the switches are closed, and outputs signals representative of the state of the switches as inputs to microcontroller 132. Microcontroller 132 determines the duration of closure in response to inputs from signal detector 135. Signal detector 135 may be any form of conventional circuit for detecting a switch closure and converting it to a form suitable as an input to a microcontroller 132. Those skilled in the art will understand how to construct signal detector 135 without the need for further explanation herein.

In normal operating mode, closure of a raise switch R, such as by a user depressing actuator 14*a*, initiates a preprogrammed "raise light level" routine in microcontroller 132 and causes microcontroller 132 to decrease the off (i.e., non-conduction) time of controllably conductive device 118 via gate drive circuit 131. Decreasing the off time increases the amount of time controllably conductive device 118 is conductive, which means that a greater proportion of AC voltage from the AC input is transferred to lighting load 116. Thus, the light intensity level of lighting load 116 may be increased. The off time decreases as long as the raise switch R remains closed. After the raise switch R opens, e.g., by the user releasing actuator 14*a*, the routine in the microcontroller is terminated, and the off time is held constant.

In a similar manner, closure of a lower switch L, such as by a user depressing actuator 14*b*, initiates a preprogrammed "lower light level" routine in microcontroller 132 and causes microcontroller 132 to increase the off time of controllably conductive device 118 via gate drive circuit 131. Increasing the off time decreases the amount of time controllably conductive device 118 is conductive, which means that a lesser proportion of AC voltage from the AC input is transferred to lighting load 116. Thus, the light intensity level of lighting load 116 may be decreased. The off time is increased (without turning off the dimmer) as long as the lower switch L remains closed. After the lower switch L opens, e.g., by the user releasing actuator 14*b*, the routine in the microcontroller 132 is terminated, and the off time is held constant.

The toggle switch T is closed in response to actuation of actuator 16, and will remain closed for as long as actuator 16 is depressed. Signal detector 135 provides a signal to microcontroller 132 indicating that the toggle switch T has been closed. Microcontroller 132 determines the length of time that the toggle switch T has been closed. Microcontroller 132 can discriminate between a closure of the toggle switch T that is of only transitory duration and a closure of the toggle switch T that is of more than a transitory duration. Thus, microcontroller 132 is able to distinguish between a "tap" of the actuator 16 (i.e., a closure of transitory duration) and a "hold" of the actuator 16 (i.e., a closure of more than transitory duration).

Microcontroller 132 is also able to determine when the toggle switch T is transitorily closed a plurality of times in succession. That is, microcontroller 132 is able to determine the occurrence of two or more taps in quick succession.

In an example embodiment of a wallbox dimmer operating in normal operational mode, different closures of the toggle switch T will result in different effects depending on the state of lighting load 116 when the actuator 16 is actuated. For example, when the lighting load 116 is at an initial, non-zero intensity level, a single tap of actuator 16, i.e., a transitory closure of toggle switch T, may cause the load to fade to off. Two taps in quick succession may initiate a routine in microcontroller 132 that causes the lighting load 116 to fade from the initial intensity level to the full intensity level at a preprogrammed fade rate. A "hold" of the actuator 16, i.e., a closure of toggle switch T for more than a transitory duration, may initiate a routine in microcontroller 132 that gradually fades in a predetermined fade rate sequence over an extended period of time from the initial intensity level to off.

When the lighting load 116 is off and microcontroller 132 detects a single tap or a closure of more than transitory duration, a preprogrammed routine is initiated in microcontroller 132 that causes the lighting load 116 to fade from off to a preset desired intensity level at a preprogrammed fade rate. Two taps in quick succession will initiate a routine in microcontroller 132 that causes the light intensity level of the lighting load 116 to fade at a predetermined rate from off to full. The fade rates may be the same, or they may be different.

Preferably, all of the previously-described circuitry is contained in a standard, single-gang wallbox, schematically illustrated in FIG. 3 by the dashed outline labeled W. An additional set of switches R', L' and T' may be provided in a remote location in a separate wallbox, schematically illustrated in FIG. 3 by the dashed outline, labeled REM. The action of switches R', L' and T' corresponds to the action of switches R, L and T.

A wallbox dimmer such as described above may be preprogrammed to provide certain features, examples of which are described below. The value(s) associated with the feature(s) may be stored in memory 137 in the wallbox dimmer. When the feature is employed during normal operation of the dimmer, the microcontroller 132 may access the memory 137 to retrieve the value(s) and cause the dimmer to perform according to the stored value(s).

According to the invention, a user may "program" the dimmer by selecting respective desired values for each of one or more features provided by the dimmer. It will be appreciated from the description below that, in general, the dimmer will perform differently according to different values for the features.

Examples of such features include, without limitation, protected preset, high-end trim, low-end trim, adjustable delay, fade time, and load type. Each of these features will now be described, along with typical values that may be set for the features.

As described above, "protected preset" is a feature that allows the user to lock the present light intensity level as a protected preset lighting intensity to which the dimmer should set the lighting load 116 turned on by actuation of actuator 16. When the dimmer is turned on via actuator 16 while protected preset is disabled, the dimmer will set the lighting load 116 to the intensity level at which the dimmer was set when the lighting load was last turned off. When the dimmer is turned on via actuator 16 while protected preset is enabled, the dimmer will set the lighting load 116 to the protected preset intensity level.

According to an aspect of the invention, the protected preset value may be user-programmed. That is, the user may select a value from among a plurality of allowable values for the protected preset light intensity level. When the lighting load 116 is turned on with protected preset enabled, the microcontroller 132 will access the memory 137 to retrieve the user-selected value, and cause the lighting load 116 to be set to the intensity level represented by that value.

"High end trim" is a feature that governs the maximum intensity level to which the lighting load 116 may be set by the dimmer. Typical values for the high end trim range between about 60% and about 100% of full intensity. In an example embodiment, the high end trim may be preprogrammed to about be 90% of full intensity. In a wallbox dimmer according to the invention, high end trim is a feature that may be user-programmed as described below.

Similarly, "low end trim" is a feature that governs the minimum intensity level to which the lighting load 116 may be set by the dimmer. Typical values for the low end trim range between about 1% and about 20% of full intensity. In an example embodiment, the low end trim may be preprogrammed to about be 10% of full intensity. In a wallbox dimmer according to the invention, low end trim is a feature that may be user-programmed as described below.

"Delay-to-off" is a feature that causes the lighting load 116 to remain at a certain intensity level for a prescribed period of time before fading to off. Such a feature may be desirable in certain situations, such as, for example, when a user wishes to turn out bedroom lights before retiring, but still have sufficient light to make his way safely to bed from the location of the wallbox dimmer before the lights are completely extinguished. Similarly, the night staff of a large building may need to extinguish ambient lights from a location that is some distance away from an exit, and may wish to delay the fade to off for a period of time sufficient for them to walk safely to the exit. Typical delay-to-off times range from about 10 seconds to about 60 seconds.

According to an aspect of the invention, the delay-to-off time may be user-programmed. That is, the user may select a value from among a plurality of allowable values for the delay-to-off time. When the lighting load is turned off with the delay-to-off feature enabled, the microcontroller 132 will access the memory 137 to retrieve the user-selected value of delay-to-off feature. The microcontroller 132 will cause the lighting load 116 to remain at the current intensity level for a time represented by the user-selected value of delay-to-off feature.

"Fading" is a feature, described generally above, whereby the dimmer causes the lighting load to change from one intensity level to another at a certain rate or plurality of successive rates based on different closures of the toggle switch T and depending on the state of lighting load 116 when the actuator 16 is actuated.

U.S. Pat. No. 5,248,919 ("the 919 patent") discloses a lighting control device that is programmed to cause a lighting load to fade: a) from an off state to a desired intensity level, at a first fade rate, when the input from a user causes a closure of the intensity actuation switch; b) from any intensity level to the maximum intensity level, at a second fade rate, when the input from a user causes two switch closures of transitory duration in rapid succession; c) from the desired intensity level to an off state, at a third fade rate, when the input from a user causes a single switch closure of a transitory duration; and d) from the desired intensity level to an off state, at a fourth fade rate, when the input from a user causes a single switch closure of more than a transitory duration. The lighting control device may cause the load to fade from a first intensity level to a second intensity level at a fifth fade rate when the intensity selection actuator is actuated for a period of more than transitory duration. The 919 patent is incorporated herein by reference.

U.S. Pat. No. 7,071,634, the disclosure of which is incorporated herein by reference, discloses a lighting control device that is capable of activating a long fade off from any light intensity.

According to an aspect of the invention, any or all of the features that define the fade features may be user-programmed. When the actuator 16 is actuated, depending on the state of lighting load 116 when the actuator 16 is actuated, and based on the number and type of closures of the toggle switch T, the microcontroller 132 may access the memory 137 to retrieve one or more of the user-selected values. The microcontroller 132 will cause the lighting load 116 to fade according to a fade profile based on the user-selected value of fade feature.

Another feature that may be programmed in accordance with the invention is "load type." As described above, the load type may be inductive, resistive, or capacitive. Forward phase-controlled dimming may be desirable where the load is inductive or resistive; reverse phase-controlled dimming may be desirable where the load is capacitive. Thus, the load type may be defined, at least in part, by a feature having a value associated with either forward phase control or reverse phase control.

Figure 4A:
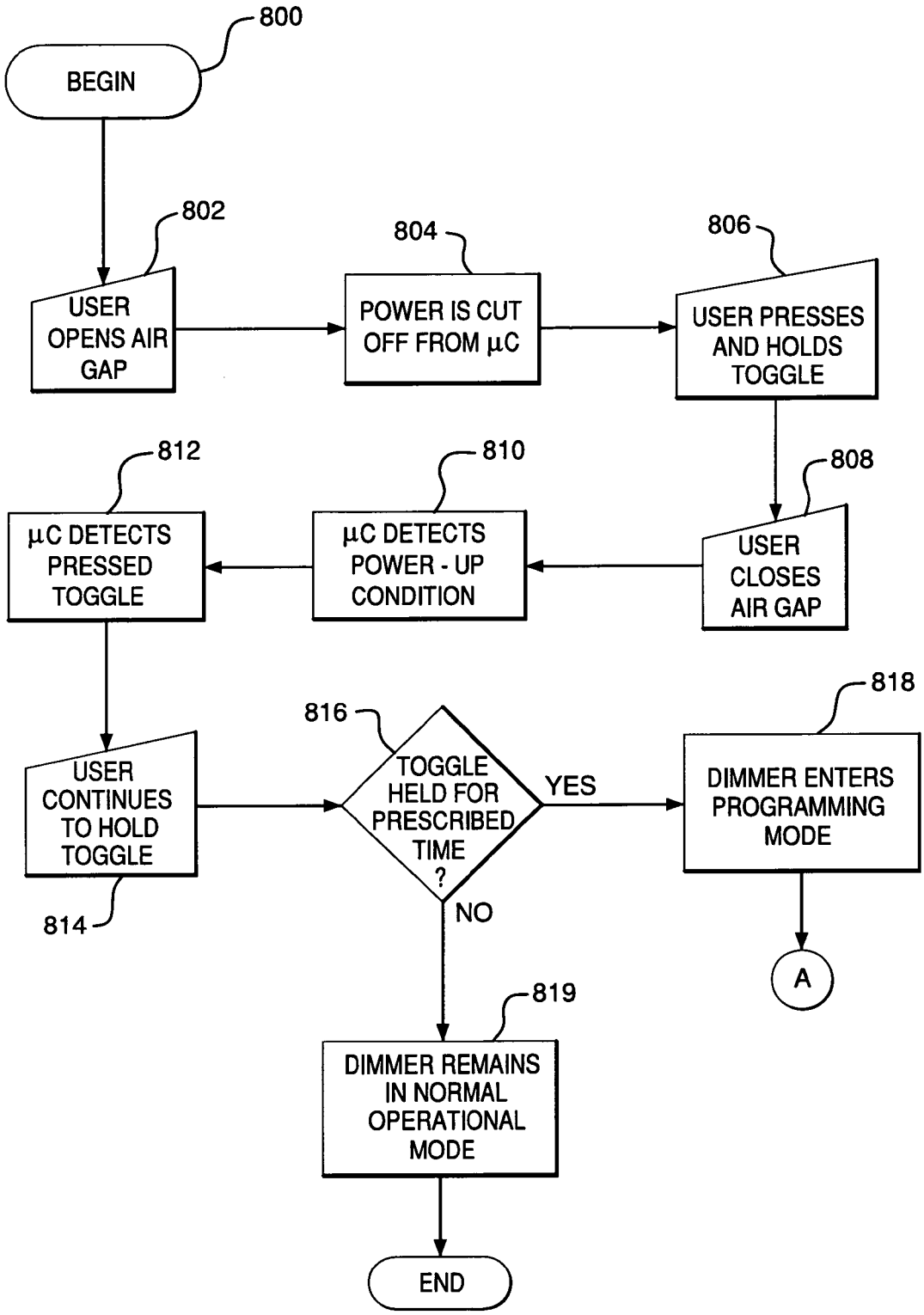
FIGS. 4A–C provide a flowchart of a method according to the invention for programming a wallbox dimmer.
Figure 4B:
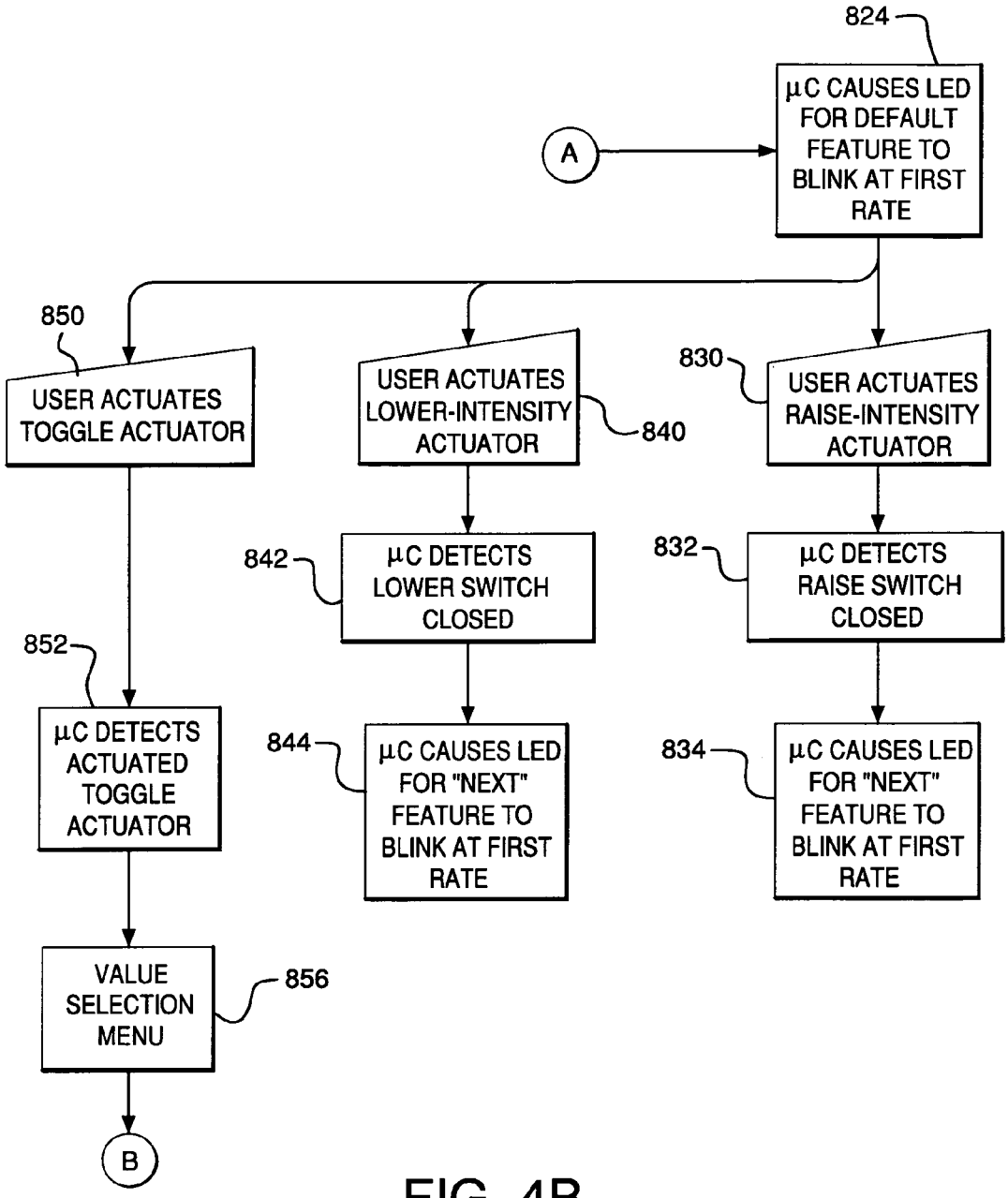
Figure 4C:
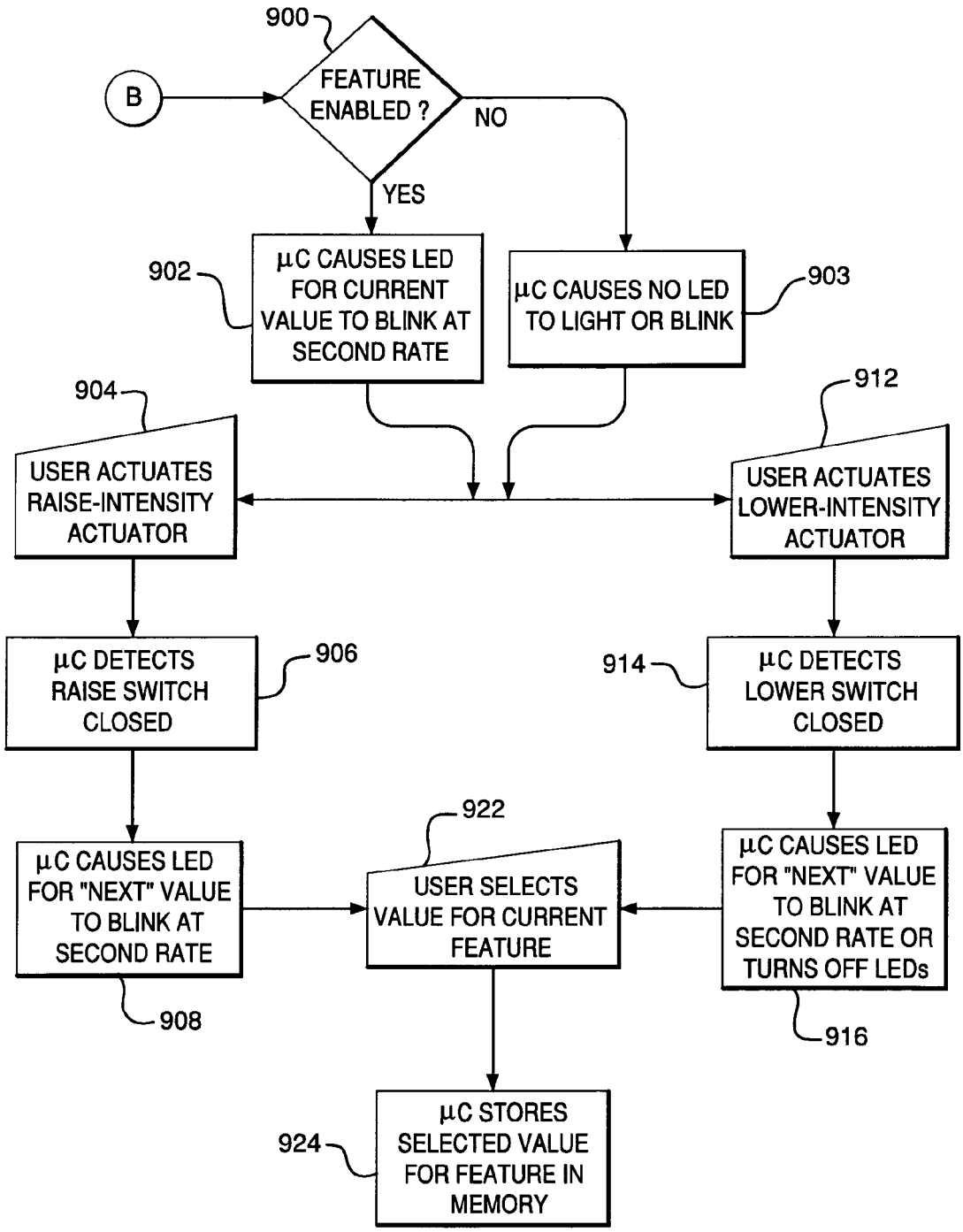

FIGS. 4A–C provide flowcharts of an example embodiment of a method according to the invention for programming a wallbox dimmer. Such a method may be implemented as a set of computer-executable instructions stored on a computer-readable medium, such as a random-access or read-only memory within the wallbox dimmer. Such computer-executable instructions may be executed by a microcontroller, such as a microprocessor, within the wallbox dimmer. The microcontroller 132 is referred to as "μC" in FIGS. 4A–C.

The flow begins assuming the dimmer is operating in its normal operational mode. In normal operational mode, the toggle actuator 16 toggles the lights between on and off. A double tap on the toggle actuator 16 causes the lights to go to 100% intensity. Pressing and holding the toggle actuator 16 causes the lights to fade to off. Actuating the upper portion 14*a* of actuator 14 raises the intensity level of the lighting load 116. Actuating the lower portion 14*b* of actuator 14 lowers the intensity level of the lighting load 116. When the lights are on, the LED corresponding to the current intensity level is lit. When the lights are off, the LEDs are dimly lit, with the LED corresponding to the preset level being slightly brighter than the others.

In an example embodiment, the dimmer may enter a programming mode in accordance with the following beginning in normal operation at 800. First, at step 802, the user opens the air gap switch 146 by opening the air gap switch actuator 17. At step 804, power is cutoff from the microcontroller 132 because the air gap switch 146 has been opened. At step 806, with the air gap switch 146 open, the user presses and begins to hold the toggle actuator 16. At step 808, while holding the toggle actuator 16, the user closes the air gap actuator 17. At step 810, the microcontroller 132 detects a power-up condition, i.e., that power has been restored through the air gap switch 146. At step 812, the microcontroller 132 detects that the toggle actuator 16 is being held closed. At step 814, the user continues to press and hold the toggle actuator 16 for at least a prescribed period of time (e.g., four seconds) after the air gap switch 146 is closed. If, at step 816, the microcontroller 132 determines that the toggle actuator 16 has been held for at least the prescribed period of time, then, at step 818, the dimmer enters programming mode. Otherwise, at step 819, the dimmer remains in normal operational mode.

Upon entering the programming mode, the dimmer enters a feature selection mode in which the user may select one or more features to program. In the feature selection mode, each of one or more of the LEDs is associated with a respective programmable feature. The microcontroller 132 may cause the LED associated with a default feature to begin to blink at a relatively slow first blink rate. Preferably, the default feature is associated with the lowest LED of light indicators 18. The list of programmable features presented in the feature selection mode may be referred to as the "main menu."

At step 824, the microcontroller 132 causes the LED associated with the default feature to blink at the first blink rate. In an example embodiment, the first blink rate may be 2 Hz, though it should be understood that the first blink rate may be any desired rate.

While in the feature selection mode, the user may actuate the raise/lower switches to scroll through the list of programmable features. For example, at step 830, the user may actuate the raise-intensity actuator 14*a*. At step 832, the microcontroller 132 detects that the raise-intensity switch R has been closed. At step 834, the microcontroller 132 causes the LED associated with the "next" programmable feature to blink at the first blink rate. The decision as to which programmable feature is "next" is purely arbitrary and can be programmed into the microcontroller 132. In an example embodiment, the "next" feature is the feature associated with the LED that is just above the currently blinking LED.

The user may continue to scroll through the list of programmable features by continuing to hold down the raise-intensity actuator 14*a* (or by successively pressing the raise-intensity actuator 14*a*). If the microcontroller 132 determines that the uppermost LED is currently blinking, then, at step 834, the microcontroller causes the uppermost LED to continue to blink.

Similarly, at step 840, the user may actuate the lower-intensity actuator 14*b*. At step 842, the microcontroller 132 detects that the lower-intensity switch has been closed. At step 844, the microcontroller 132 causes the LED associated with the "next" programmable feature to blink at the first blink rate. Again, the decision as to which programmable feature is "next" is purely arbitrary, and can be programmed into the microcontroller 132. In an example embodiment, the "next" feature is the feature associated with the LED that is just below the currently blinking LED.

The user may continue to scroll through the list of programmable features by continuing to hold down the lower-intensity actuator 14*b* (or by successively pressing the lower-intensity actuator 14*b*). If the microcontroller 132 determines that the lowermost LED is currently blinking, then, at step 844, the microcontroller causes the lowermost LED to continue to blink.

At step 850 the user may actuate the toggle actuator 16 to select the currently presented feature (i.e., the feature associated with the LED that is blinking when the user actuates the toggle actuator 16). At step 852, the microcontroller 132 detects that the toggle switch T has been actuated and, at step 856, the microcontroller enters a value selection mode.

In the value selection mode, each of one or more LEDs is associated with a respective prescribed value that may be selected for the selected feature. The user may scroll through the values and select a value for the selected feature.

If, at step 900, the microcontroller 132 determines that the selected feature is currently enabled, then, upon entering the value selection mode, at step 902, the LED associated with the current value for the selected feature will begin to blink at a relatively fast, second blink rate (i.e., at a rate that is faster than the first blink rate). In an example embodiment, the second blink rate may be 8 Hz, though it should be understood that the second blink rate may be any desired rate. If, at step 900, the microcontroller 132 determines that the selected feature is not currently enabled (i.e., if the selected feature is disabled), then, at step 903, upon entering the value selection mode, no LED will light or blink.

While in the value selection mode, the user may actuate the raise-intensity actuator 14*a* and the lower-intensity actuator 14*b* to scroll through the list of available values associated with the selected feature. For example, at step 904, the user may actuate the raise-intensity actuator 14*a*. At step 906, the microcontroller 132 detects that the raise-intensity switch R has been closed. At step 908, the microcontroller 132 causes the LED associated with the "next" available value to blink at the second blink rate. The decision as to which value is "next" is purely arbitrary, and can be programmed into the microcontroller 132. In an example embodiment, the "next" value is the value associated with the LED that is just above the currently blinking LED. Alternatively, the "next" value could be a value associated with the same LED as the currently blinking LED. For example, this may be the case if the selected feature is the protected preset intensity level, when the value can be any intensity level between 1% and 100% (i.e. each value will not have a unique LED to be associated with).

The user may continue to scroll through the list of available values by continuing to hold down the raise-intensity actuator 14*a* (or by successively pressing the raise-intensity actuator 14*a*). If the microcontroller 132 determines that the uppermost LED is currently blinking, then, at step 908, the microcontroller causes the uppermost LED to continue to blink. If the microcontroller 132 determines that the feature is disabled and the raise-intensity actuator is pressed, then the microcontroller causes the lowermost LED to blink.

Similarly, at step 912, the user may actuate the lower-intensity actuator 14*b*. At step 914, the microcontroller 132 detects that the lower-intensity switch L has been closed. At step 916, the microcontroller 132 causes the LED associated with the "next" value to blink at the second blink rate. Again, the decision as to which value is "next" is purely arbitrary, and can be programmed into the microcontroller 132. In an example embodiment, the "next" value is the value associated with the LED that is just below the currently blinking LED. Alternatively, the "next" value could be the value associated with the same LED as the currently blinking LED.

The user may continue to scroll through the list of available values by continuing to hold down the lower-intensity actuator 14*b* (or by successively pressing the lower-intensity actuator 14*b*). If the microcontroller 132 determines that the lowermost LED is currently blinking, then, at step 916, the microcontroller causes no LEDs to blink and disables the current feature. If the microcontroller 132 determines that the feature is disabled and the lower-intensity actuator is pressed, then the microcontroller keeps the feature disabled with no LEDs blinking.

At step 922, the user selects a value for the selected feature, and, at step 924, the microcontroller 132 stores the value in memory 137. The user may select the value at step 922 in any of a number of ways.

In a first embodiment of the invention, the feature value may be set (i.e., stored in memory 137) as the user cycles through the prescribed values. Thus, the user may select a value for the feature by merely scrolling through the list of prescribed values until the desired value is highlighted (e.g., the LED associated with the desired value is blinking). Also, for certain features, e.g., protected preset, the dimmer may also be programmed to control the intensity of the lighting load 116 as the user cycles through the prescribed values. Thus, the user may see the effect the currently presented value will have on dimmer performance.

In an alternate embodiment, the microcontroller 132 stores the currently presented value (i.e., the value that is associated with the LED that is blinking when the rocker is released) after the user releases the raise-intensity actuator 14*a* or the lower-intensity actuator 14*b* for a period of time. Thus, the user can scroll through the values without changing the value in memory 137 until the actuator 14 is released for the prescribed period of time.

In a third embodiment, the value of the feature does not change in memory 137 unless the toggle actuator 16 is selected within a prescribed period of time from the time at which the raise-intensity actuator 14*a* or the lower-intensity actuator 14*b* is released.

If a feature is defined by more than one variable parameter, it might be desirable to provide another mode presenting a list of user-programmable parameters similar to the feature selection mode. According to an aspect of the invention, any or all of these variable parameters may be programmed. That is, if the user selects a feature in the feature selection mode that is defined by more than one parameter, then a parameter selection mode (rather than the value selection mode) may be entered wherein each of one or more LEDs is associated with a respective variable parameter that defines the selected feature. The user may scroll through the parameters of the parameter selection mode and select a parameter to program.

For example, fading is a feature that may be defined by a number of parameters, such as, fade off rate, fade off time, long fade time, button hold time, etc. Fading may be presented as an option in the feature selection mode by association with one the LEDs. If the user selects fading in the feature selection mode, then a parameter selection mode may be entered wherein each of one or more LEDs is associated with a respective variable parameter that defines the fading feature.

It should be understood that, even where the selected feature has only one programmable variable parameter associated with it, a parameter selection mode could be provided (though such a mode would, by definition, offer only one variable parameter from which to choose). It should also be understood that a parameter selection mode need not be provided, even where a programmable feature has more than one variable parameter. For example, the feature selection mode may present not just the feature (e.g., fading), but rather, the programmable parameters that define the feature (e.g., fade off rate, fade off time, long fade time, button hold time, etc).

To go back to a previous mode (e.g., to go from the value selection mode to the feature selection mode if there is no parameter selection mode associated with the selected feature, or, if there is a parameter selection mode, to go from the value selection mode to the parameter selection mode or from the parameter selection mode to the feature selection mode), the user may press the toggle actuator 16.

In an example embodiment, the user may exit programming mode and return the dimmer to normal operating mode in any of three ways. First, the user could do nothing (i.e., not actuate any switch) for a prescribed timeout period. Alternatively, the user could cycle the air gap switch actuator 17. A third way to exit programming mode is to press and hold the toggle actuator 16 for a prescribed period of time (e.g., four seconds). Preferably, programming mode may be exited from the feature selection mode, any parameter selection mode, or any value selection mode.

The following table provides examples of programmable features that may be provided by a wallbox dimmer according to the invention. For each feature, example values that define the feature are provided.

| Programmable Feature | Prescribed Value |
|---|---|
| High End Trim (%) | 100, 95, 90, 85, 80, 75, 70 |
| Low End Trim (%) | 0, 5, 10, 15, 20, 25, 30 |
| Load Type | Reverse Phase Controlled, Forward Phase Controlled |
| Delay-To-Off (sec) | 0, 10, 20, 30, 40, 50, 60 |
| Protected Preset | Any level between high-end and low-end |
| Fade Off Rate (sec) | 0.5, 1, 2, 3, 4 |
| Fade Off Time (sec) | 1, 3, 5, 10, 15 |

It should be understood that the foregoing examples are provided for illustrative purposes only, and that other features may be programmed in accordance with the principles of the invention. Other possible features that may be programmed include, without limitation, zone exclusion, disabling of certain remote commands, and addressing of remote dimmers in a dimming system wherein a number of remote dimmers are controlled by a master control.

Thus there have been described apparatus and methods for programming certain features provided by a wallbox dimmer. Other modifications of these apparatus and methods and of their application to the design of electronic dimmers will be readily apparent to one of ordinary skill in the art, but are included within the invention, which is limited only by the scope of the appended claims.

What is claimed:

1. A lighting control device for controlling a light intensity level of a lamp, said lighting control device comprising:

an intensity level switch;

a control switch;

an air gap switch; and a microcontroller operatively coupled to the intensity level switch, the control switch, and the air gap switch, wherein, in a normal operational mode, the intensity level switch enables a user to select a desired light intensity level between a minimum intensity level and a maximum intensity level, the control switch enables the user to toggle the lamp between an on state and an off state, and the air gap switch enables the user to interrupt power supplied to the microcontroller and to the lamp, and wherein the microcontroller is adapted to cause the lighting control device to enter a programming mode after detecting that the control switch had been actuated when the microcontroller was being powered up and that the control switch has remained actuated for at least a prescribed period of time after the microcontroller was powered up.

2. The lighting control device of claim 1, wherein the programming mode includes a feature selection mode wherein the user may select a programmable feature of the lighting control device.

3. The lighting control device of claim 2, wherein the user may select the programmable feature from among a plurality of programmable features.

4. The lighting control device of claim 3, further comprising a respective programmable feature indicator associated with each of the plurality of programmable features.

5. The lighting control device of claim 4, wherein each of the programmable feature indicators includes a respective light source, said light sources are disposed in a sequence, and each of said light sources represents a respective one of the plurality of programmable features.

6. The lighting control device of claim 4, wherein, in the feature selection mode, the microcontroller causes a light source associated with a feature to be selected upon actuation of the control switch to blink at a first rate.

7. The lighting control device of claim 3, wherein actuation of the light intensity level switch enables for subsequent selection a desired one of the plurality of programmable features.

8. The lighting control device of claim 2, further comprising a programmable feature indicator associated with the programmable feature.

9. The lighting control device of claim 2, wherein the programming mode comprises a value selection mode wherein the user may select a programmable feature value associated with a selected programmable feature.

10. The lighting control device of claim 9, wherein the user may select the programmable feature value from among a plurality of programmable feature values.

11. The lighting control device of claim 10, further comprising a respective programmable feature value indicator associated with each of the plurality of programmable feature values.

12. The lighting control device of claim 11, wherein each of the programmable feature value indicators includes a respective light source, said light sources are disposed in a sequence, and each of said light sources represents a respective one of the plurality of programmable feature values.

13. The lighting control device of claim 11, wherein, in the feature selection mode, the microcontroller causes a light source associated with a feature to be selected upon actuation of the control switch to blink at a first rate.

14. The lighting control device of claim 13, wherein, in the value selection mode, the microcontroller causes a light source associated with a value to be selected upon actuation of the control switch to blink at a second rate that is different from the first rate.

15. The lighting control device of claim 10, wherein the microcontroller causes a selected programmable feature value to be stored in memory.

16. The lighting control device of claim 10, wherein actuation of the light intensity level switch enables for subsequent selection a desired one of the plurality of programmable feature values.

17. The lighting control device of claim 9, further comprising a programmable feature value indicator associated with the programmable feature value.

18. The lighting control device of claim 17, further comprising a programmable feature indicator associated with the programmable feature.

19. The lighting control device of claim 18, wherein the programmable feature indicator blinks at a first blink rate.

20. The lighting control device of claim 19, wherein the programmable feature value indicator blinks at a second blink rate that is different from the first blink rate.

21. The lighting control device of claim 20, wherein the first blink rate is slower than the second blink rate.

22. The lighting control device of claim 9, wherein the microcontroller causes a selected programmable feature value to be stored in memory.

23. The lighting control device of claim 1, wherein the microcontroller is adapted to cause the lighting control device to return to the normal operational mode from the programming mode if none of the intensity level switch, the control switch, and the air gap switch has been actuated for at least a prescribed timeout period.

24. The lighting control device of claim 1, wherein the microcontroller is adapted to cause the lighting control device to return to the normal operational mode from the programming mode if, while in the programming mode, the microcontroller detects that the control switch has been actuated for at least a prescribed period of time.

* * * * *